US007976647B2

(12) United States Patent
Moulin et al.

(10) Patent No.: US 7,976,647 B2
(45) Date of Patent: Jul. 12, 2011

(54) VERY HIGH MECHANICAL STRENGTH STEEL AND METHOD FOR MAKING A SHEET THEREOF COATED WITH ZINC OR ZINC ALLOY

(75) Inventors: Antoine Moulin, Metz (FR); Jean-Luc Lapointe, Jarny (FR)

(73) Assignee: USINOR, Puteaux (FR)

( * ) Notice: Subject to any disclaimer, the term of this patent is extended or adjusted under 35 U.S.C. 154(b) by 628 days.

(21) Appl. No.: 10/526,378

(22) PCT Filed: Sep. 4, 2003

(86) PCT No.: PCT/FR03/02641

§ 371 (c)(1),
(2), (4) Date: Jan. 13, 2006

(87) PCT Pub. No.: WO2004/022793

PCT Pub. Date: Mar. 18, 2004

(65) Prior Publication Data

US 2006/0102256 A1 May 18, 2006

(30) Foreign Application Priority Data

Sep. 6, 2002 (FR) ..... 02 11040

(51) Int. Cl.
*C21D 8/02* (2006.01)

(52) U.S. Cl. ..... 148/533; 148/652

(58) Field of Classification Search ..... 148/533
See application file for complete search history.

(56) References Cited

U.S. PATENT DOCUMENTS

| | | | | |
|---|---|---|---|---|
| 7,413,780 | B2 * | 8/2008 | Honda et al. | 427/433 |
| 2001/0001049 | A1 | 5/2001 | Fujita et al. | |
| 2001/0007280 | A1 * | 7/2001 | Claessens et al. | 164/476 |
| 2004/0202889 | A1 * | 10/2004 | Fujita et al. | 428/659 |

FOREIGN PATENT DOCUMENTS

| | | | |
|---|---|---|---|
| EP | 1 028 167 | A2 | 8/2000 |
| EP | 1 193 322 | | 4/2002 |
| JP | 04 173945 | A | 6/1992 |
| JP | 06 108152 | A | 4/1994 |
| JP | 07 102323 | A | 4/1995 |

OTHER PUBLICATIONS

Patent Abstracts of Japan, vol. 1995, No. 07, Aug. 31, 1995 & JP 07 102323 A (Kawasaki Steel Corp), Apr. 18, 1995.

* cited by examiner

*Primary Examiner* — George Wyszomierski
(74) *Attorney, Agent, or Firm* — Sughrue Mion, PLLC

(57) ABSTRACT

The invention concerns a very high mechanical strength steel, whereof the chemical composition comprises in wt. %: 0.006%=C=0250%; 0.400%=Mn=0.950%; Si=0.300%; Cr=0.300%; 0.100%=Mo=0.500%; 0.020%=AI=0.100%; P=0.100%; B=0.010%; Ti=0.050%, the rest being iron and impurities resulting from preparation. The invention also concerns a method for making a sheet of said steel coated with zinc or zinc alloy.

4 Claims, No Drawings

VERY HIGH MECHANICAL STRENGTH STEEL AND METHOD FOR MAKING A SHEET THEREOF COATED WITH ZINC OR ZINC ALLOY

This is a National Stage application under 35 USC 371 of PCT/FR03/02641 filed Sep. 4, 2003, which claims priority to French application 02/11040 filed Sep. 6, 2002.

The present invention relates to a very high mechanical strength steel and a method for producing a sheet of this steel coated with zinc or zinc alloy.

There are several families of very high mechanical strength steels which differ in terms of their compositions and their microstructures. The steels referred to as dual phase steels thus have a microstructure composed of ferrite and martensite, which allows them to reach tensile strengths ranging from 400 MPa to more than 1200 MPa.

In order to produce microstructures which will allow advantageous mechanical properties to be obtained, these grades are quite heavily charged in terms of elements such as chromium, silicon, manganese, aluminium or phosphorus. However, these grades present a problem when it is desirable for them to be coated with a coating to protect against corrosion, for example, by means of hot dip galvanisation.

It has been found that the surface of sheet metals has a very poor wettability relative to zinc or zinc alloys. Sheet metals therefore comprise portions which are not coated which constitute preferred zones for the onset of corrosion.

In order to overcome this problem, various approaches have been proposed. Methods are thus known which consist in carrying out a pre-coating of a metal which allows a better bonding base to be provided for the zinc. To this end, it has been proposed that iron, aluminium, copper and other elements be deposited, generally by means of electrodepositing. These methods have the disadvantage of adding a supplementary step before the galvanisation itself.

It has also been proposed that the sheets be passed into annealing furnaces which have, in particular, specific atmospheres which allow the iron to be selectively oxidised in order to form a layer of iron oxide on which the zinc is effectively deposited. However, a method of this type requires very sensitive regulation and very strict control of the oxidation conditions.

The object of the present invention is therefore to provide a steel composition which does not have the disadvantages of the compositions of the prior art and which is, in particular, very suitable for coating with zinc or zinc alloys whilst preserving the advantageous mechanical properties.

To this end, a first aspect of the invention is constituted by a very high mechanical strength steel whose chemical composition comprises, in % by weight:

0.060%≦C≦0.250%
0.400%≦Mn≦0.950%
Si≦0.300%
Cr≦0.300%
0.100%≦Mo≦0.500%
0.020%≦Al≦0.100%
P≦0.100%
B≦0.010%
Ti≦0.050% the balance being iron and impurities resulting from the production operation.

In one preferred embodiment, the steel comprises:

0.080%≦C≦0.120%
0.800%≦Mn≦0.950%
Si≦0.300%
Cr≦0.300%

0.100%≦Mo≦0.300%
0.020%≦Al≦0.100%
P≦0.100%
B≦0.010%
Ti≦0.050% the balance being iron and impurities resulting from the production operation.

This embodiment allows a sheet of steel to be produced having a tensile strength in the order of 450 MPa.

In another preferred embodiment, the steel comprises:

0.080%≦C≦0.120%
0.800%≦Mn≦0.950%
Si≦0.300%
Cr≦0.300%
0.150%≦Mo≦0.350%
0.020%≦Al≦0.100%
P≦0.100%
B≦0.010%
Ti≦0.050% the balance being iron and impurities resulting from the production operation.

This embodiment allows a sheet of steel to be produced having a tensile strength in the order of 500 MPa.

In another preferred embodiment, the steel comprises:

0.100%≦C≦0.140%
0.800%≦Mn≦0.950%
Si≦0.300%
Cr≦0.300%
0.200%≦Mo≦0.400%
0.020%≦Al≦0.100%
P≦0.100%
B≦0.010%
Ti≦0.050% the balance being iron and impurities resulting from the production operation.

This embodiment allows a sheet of steel to be produced having a tensile strength in the order of 600 MPa.

In another preferred embodiment, the steel has a microstructure which is constituted by ferrite and martensite.

A second aspect of the invention is constituted by a sheet of very high mechanical strength steel according to the invention which is coated with zinc or zinc alloy.

A third aspect of the invention is constituted by a method for producing a sheet of steel according to the invention coated with zinc or zinc alloy, which method comprises the steps consisting of:

- producing a slab whose composition is in accordance with the invention, and hot-rolling then cold-rolling the slab in order to produce a sheet,
- heating the sheet at a rate of between 2 and 100° C./s until a holding temperature of between 700 and 900° C. is reached,
- cooling the sheet at a rate of between 2 and 100° C./s until a temperature is reached which is close to that of a bath containing molten zinc or a zinc alloy, then
- coating the sheet with zinc or a zinc alloy by means of immersion in the bath and cooling it to ambient temperature at a cooling rate of between 2 and 100° C./s.

In another preferred embodiment, the sheet is kept at the holding temperature for from 10 to 1000 seconds.

In another preferred embodiment, the bath containing molten zinc or zinc alloy is kept at a temperature of between 450 and 480° C., and the immersion time of the sheet is in the order of between 2 and 400 seconds.

In another preferred embodiment, the bath principally contains zinc.

A fourth aspect of the invention is constituted by the use of a very high mechanical strength sheet of steel coated with zinc or zinc alloy in the production of automotive components.

The present invention is based on the novel observation that, by limiting the contents in terms of manganese, silicon and chromium to the maximum values claimed, excellent coatability can be achieved for the grades produced in this manner. In accordance with the desired level of mechanical properties, the contents will be adjusted in terms of the quenching elements, such as carbon and molybdenum, which have been found not to impair this coatability.

Owing to the improved galvanisability thereof, the steel according to the invention is used in particular for applications in the field of producing automotive components and, more particularly, for producing visible components, such as bodywork elements, which will have an attractive appearance after painting, in contrast to those currently produced using steels of the prior art.

The present invention will now be illustrated based on the following observations and examples, given by way of non-limiting examples, Table 1 giving the chemical composition of the steels tested, in $10^{-3}$% by weight.

TABLE 1

| | C | Mn | Si | Cr | Mo | Al | B | Ti | N | P | S | Cu | Ni | V |
|---|---|---|---|---|---|---|---|---|---|---|---|---|---|---|
| A | 59 | 1195 | 121 | 491 | — | 38 | — | — | 5.4 | 11 | 2 | 6 | 23 | — |
| B | 83 | 1546 | 361 | 204 | — | 24 | — | — | 5.1 | 15 | 2 | 8 | 22 | — |
| C* | 95 | 906 | 12 | 15 | 102 | 33 | — | — | 2.3 | 25 | 4 | 9 | 20 | — |
| D* | 93 | 909 | 10 | 15 | 205 | 33 | — | — | 2.3 | 25 | 4 | 9 | 23 | 3 |
| E* | 85 | 900 | 11 | 14 | 305 | 35 | — | — | 2.6 | 25 | 4 | 9 | 25 | 3 |
| F* | 90 | 900 | 11 | 15 | 306 | 33 | 1 | 27 | 2.5 | 25 | 4 | 9 | 25 | 4 |

*according to the invention

To this end, the conventional formula can, for example, be used which provides the decimal logarithm of the critical quenching rate V (in ° C./s):

$$\text{Log}(V)=4.5-2.7\%\ C_\gamma-0.95\%\ Mn-0.18\%\ Si-0.38\%\ Cr-1.17\%\ Mo-1.29(\%\ C\times\%\ Cr)-0.33(\%\ Cr\times\%\ Mo)$$

in which $C_\gamma$ represents the carbon content of the austenite before cooling.

The steel composition according to the invention contains between 0.060% and 0.250% by weight of carbon since it has been found that, for a carbon content of less than 0.060%, the grade was no longer able to be quenched and no longer allowed the desired advantageous mechanical properties to be obtained. At more than 0.250% by weight, the carbon significantly inhibits the weldability of the grade.

The composition also contains between 0.400 and 0.950% by weight of manganese. In the same manner as for the carbon, the lower limit is required in order to obtain a quenchable grade of steel, whilst the upper limit must be complied with in order to ensure good coatability for the grade.

The composition also contains up to 0.300% by weight of silicon. The upper limit must be complied with in order to ensure good coatability for the grade.

The composition further contains up to 0.300% by weight of chromium. The upper limit must be complied with in order to ensure good coatability for the grade.

Finally, the composition according to the invention must contain between 0.100 and 0.500% by weight of molybdenum since it was found that, for a content of less than 0.100%, the grade no longer allows the desired advantageous mechanical properties to be obtained. At more than 0.500% by weight, the molybdenum significantly inhibits the weldability of the grade.

The composition may also optionally contain up to 0.010% by weight of boron which is then protected if necessary with a content of a maximum of 0.050% by weight of titanium. This last element, which has a greater affinity for nitrogen than boron, traps the boron by forming titanium nitrides.

The steel composition may also contain various unavoidable residual elements, including N, Nb, Cu, Ni, W, V.

It is particularly preferable to limit the content of nitrogen which can make the steel susceptible to ageing.

These different compositions were produced in the form of ingots of 15 kg. The ingots were then heated to 1250° C. for 45 minutes, then hot-rolled in 7 passes, the final rolling temperature being 900° C.

The sheets which are produced in this manner were cooled by means of water quenching with a retardant at a cooling rate in the order of 25° C./s, then wound at 550° C. before being cooled.

They were then cold-rolled at a reduction rate of 70% before being subjected to the following thermal cycle:

heating at a rate in the order of 30° C./s until a holding temperature between 770° C. and 810° C. is reached for a time of between 50 and 80 seconds in order to simulate line speeds ranging from 80 to 150 m/min, cooling the sheet at a rate in the order of 10° C./s until 470° C. is reached.

The sheets are then subjected to hot dip galvanisation in a bath of zinc, with a dwell time in the bath which is dependent on the line speed selected (between 80 and 150 m/min), then cooled at a rate of 5° C./s to ambient temperature.

The following mechanical properties are then measured for each sheet:

Rm: tensile strength in MPa,

Rel: limit of elasticity in MPa,

A: elongation at break in %,

Ag: distributed elongation in %,

P: level in %, as well as the martensite proportion of the sheets (% M).

Test 1: Influence of the Molybdenum Content and the Presence of Boron

This influence was examined for the grades A to F, for a holding temperature of 790° C. and a line speed of 120 m/min.

| | Rm | Rel | A | Ag | P | % M |
|---|---|---|---|---|---|---|
| A | 480 | 375 | 28.2 | 18.8 | 2.3 | 1 |
| B | 540 | 360 | 28.3 | 17.6 | — | 3 |
| C* | 466 | 380 | 28.8 | 19.9 | 4.6 | 1 |
| D* | 526 | 324 | 29.0 | 18.8 | 0.6 | 4 |

-continued

| | Rm | Rel | A | Ag | P | % M |
|---|---|---|---|---|---|---|
| E* | 563 | 282 | 26.6 | 17.9 | 0 | 7 |
| F* | 673 | 393 | 15.2 | 11.8 | 0 | 6 |

*according to the invention

For the grades according to the invention, it has been found that, by increasing the molybdenum content, the martensite content increases which allows the tensile strength to be increased and the limit of elasticity to be decreased.

However, the addition of boron does not bring about an increase n the percentage of martensite, but instead leads to a refinement of the martensite and the carburized phases.

Test 2: Influence of the Thermal Processing

The influence was examined for the grade D for three line speeds and for three holding temperatures (in m/min):

| | Holding temperature | Line speed | Rm | A | % M |
|---|---|---|---|---|---|
| Grade D | 770 | 80 | 502 | 29.4 | 1 |
| | | 120 | 528 | 27.6 | 4 |
| | | 150 | 534 | 27.3 | 6 |
| | 790 | 80 | 500 | 26.2 | 2 |
| | | 120 | 526 | 29.0 | 4 |
| | | 150 | 530 | 28.6 | 6 |
| | 810 | 80 | 505 | 29.9 | 3 |
| | | 120 | 521 | 25.8 | 4 |
| | | 150 | 530 | 26.4 | 6 |

It has been found that the holding temperature and the line speed have little influence on the mechanical properties obtained. This is a significant advantage for an industrial application which must not be susceptible to this type of variation.

This influence was then examined for the grade F:

| | Holding temperature | Line speed | Rm | A | % M |
|---|---|---|---|---|---|
| Grade F | 770 | 80 | 692 | 18.6 | 6 |
| | | 120 | 687 | 15.3 | 6 |
| | | 150 | 715 | 13.7 | 6 |
| | 790 | 80 | 664 | 17.3 | 6 |
| | | 120 | 673 | 15.2 | 6 |
| | | 150 | 688 | 16.6 | 6 |
| | 810 | 80 | 634 | 15.9 | 6 |
| | | 120 | 654 | 16.0 | 6 |
| | | 150 | 666 | 17.7 | 6 |

It has been found that the addition of boron to the grade according to the invention notably stabilises the proportion of martensite formed which does not vary at all, regardless of the parameters of the thermal processing.

Test 3: Galvanisability

Sheets of the grades A, B, C and F are hot dip galvanised and by the dew point being adjusted to −40° C. The sheets which are produced in the grades A and B have gaps in their coatings, in contrast to the grades C and F which have continuous coatings.

The invention claimed is:

1. Method for producing a very high mechanical strength steel sheet coated with zinc or zinc alloy, comprising the steps of:

producing a slab having a chemical composition, in % by weight, consisting of:

0.060%≦C≦0.250%

0.800%≦Mn≦0.950%

Si≦0.300%

Cr≦0.015%

0.150%≦Mo≦0.500%

0.020%≦Al≦0.100%

P≦0.100%

B≦0.010%

Ti≦0.050% the balance being iron and impurities resulting from the production of the slab, the microstructure thereof being constituted by ferrite and martensite, hot-rolling then cold-rolling the slab in order to produce a sheet, heating the sheet at a rate of between 2 and 100° C./s until a holding temperature of between 700 and 900° C. is reached, cooling the sheet at a rate of between 2 and 100° C./s until a temperature is reached which is about that of a bath containing molten zinc or a zinc alloy, then coating the sheet with zinc or a zinc alloy by means of immersion in the bath and cooling it to ambient temperature at a cooling rate of between 2 and 100° C./s, wherein the steel is dual-phase; and wherein the steel is used for producing automotive components.

2. Method according to claim 1, wherein the sheet is kept at the holding temperature for from 10 to 1000 seconds.

3. Method according to claim 1, wherein the bath containing molten zinc or a zinc alloy is kept at a temperature of between 450 and 480° C., and in that the immersion time of the sheet is in the order of between 2 and 400 seconds.

4. Method according to claim 1, wherein the bath principally contains zinc.

* * * * *